United States Patent [19]

Bouko et al.

[11] Patent Number: 5,036,336

[45] Date of Patent: Jul. 30, 1991

[54] SYSTEM FOR THE INTEGRATION OF I.F.F. SUM AND DIFFERENCE CHANNELS IN A RADAR SURVEILLANCE ANTENNA

[75] Inventors: Jean Bouko, Villemoisson; Joseph Roger, Bures sur Yvette, both of France

[73] Assignee: Thomson-CSF, Puteaux, France

[21] Appl. No.: 425,814

[22] Filed: Oct. 23, 1989

[30] Foreign Application Priority Data

Oct. 28, 1988 [FR] France ..... 88 14134

[51] Int. Cl.[5] ..... H01Q 1/42

[52] U.S. Cl. ..... 343/789; 343/778; 343/776; 343/853

[58] Field of Search ..... 343/789, 771, 853, 844, 343/776, 777, 778; 342/43, 45

[56] References Cited

U.S. PATENT DOCUMENTS

| | | | |
|---|---|---|---|
| 3,045,238 | 7/1962 | Cheston | 343/776 |
| 3,482,251 | 12/1969 | Bowes, Jr. | 343/776 |
| 3,495,262 | 2/1970 | Paine | 343/776 |
| 3,568,204 | 3/1971 | Blaisdell | 343/725 |
| 4,047,179 | 9/1977 | Applebaum | 343/768 |
| 4,096,482 | 6/1978 | Walters | 343/776 |
| 4,242,685 | 12/1980 | Sanford | 343/853 |

FOREIGN PATENT DOCUMENTS

| | | |
|---|---|---|
| 0025739 | 8/1980 | European Pat. Off. . |
| 0018476 | 12/1980 | European Pat. Off. . |
| 0279050 | 8/1988 | European Pat. Off. . |
| 2139216 | 2/1973 | Fed. Rep. of Germany . |
| 2315241 | 10/1974 | Fed. Rep. of Germany . |
| 1271598 | 7/1960 | France . |

*Primary Examiner*—Michael C. Wimer
*Assistant Examiner*—Hoanganh Le
*Attorney, Agent, or Firm*—Roland Plottel

[57] ABSTRACT

The I.F.F. sum and difference channels are obtained by means of the reflector of the radar, illuminated by primary radiating elements associated with the horn of the primary source of the radar. Furthermore, the signals of the I.F.F. sum and difference channels are suitably mixed to obtain a reduction in the level of the cross-polarized signals.

4 Claims, 4 Drawing Sheets

FIG_1
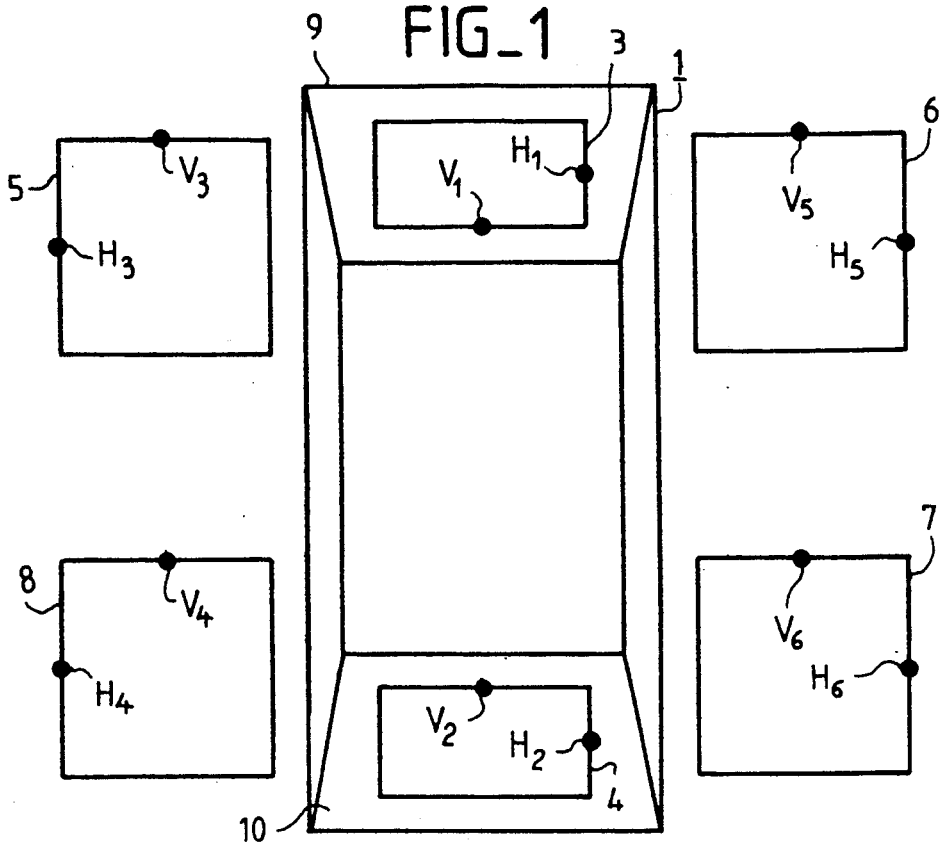
FIG_4-a
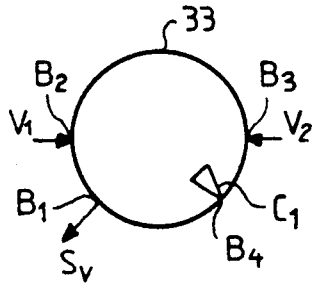
FIG_5-a
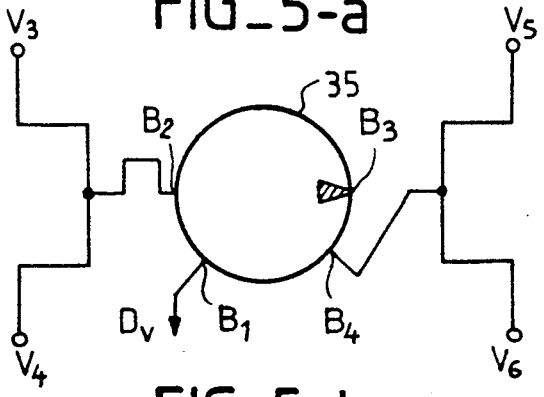
FIG_4-b
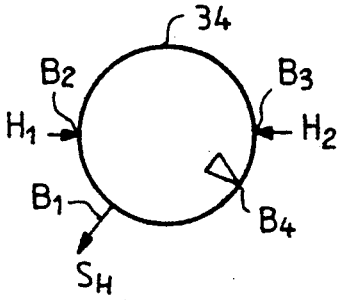
FIG_5-b
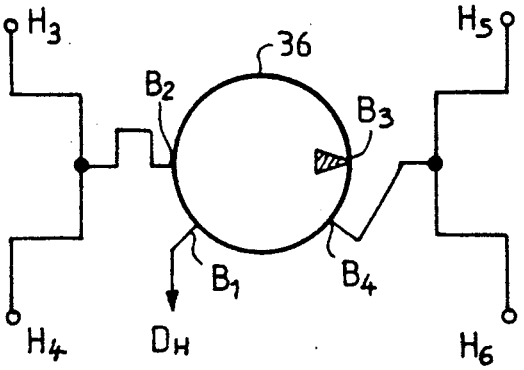

SYSTEM FOR THE INTEGRATION OF I.F.F. SUM AND DIFFERENCE CHANNELS IN A RADAR SURVEILLANCE ANTENNA

BACKGROUND OF THE INVENTION

1. Field of the Invention

The invention concerns radar surveillance antennas and, more particularly, in such antennas, a system for identifying targets by encoded interrogations, the antenna of this system being associated with the antenna of the surveillance radar.

2. Description of the Prior Art

Radars can be used to detect the presence of objects or targets and to determine certain of their characteristics such as their distance, altitude and speed. However, they cannot be used in wartime to determine whether the target is a friend or a foe. Such determining is done by using a system that "interrogates" the targets by sending them encoded signals which are detected by these targets. The targets may then emit encoded signals, indicating their respective category, to the interrogator system. A target that does not "respond" appropriately to the encoded signals is considered to be a foe.

An interrogator/responder system such as this, more commonly known as an I.F.F. (Identification Friend or Foe) system, is much used in peacetime for it enables a radar operator to easily identify the aircraft with which he is in radio contact by asking it to emit a determined encoded signal. This encoded signal appears in a particular form on the radar screen in the vicinity of the corresponding radar signal. For obvious reasons, the antenna of the I.F.F. system is borne by the radar antenna, and this results in a very bulky and heavy unit.

To overcome this problem, it has been proposed to use a single antenna for both the radar and the I.F.F. functions. An antenna such as this is, for example, made by means of a so-called primary source of radar signals which illuminates a reflector. Dipoles are associated with the primary source. These dipoles emit I.F.F. signals and also illuminate the radar reflector. Such an approach is not entirely satisfactory for the I.F.F. channel cannot be optimized while the level of the cross-polarized signals is too high to comply with certain technical standards laid down in aeronautics.

SUMMARY OF THE INVENTION

An aim of the invention, therefore, is a system for the integration of I.F.F. sum and difference channels in a radar surveillance antenna, that does not have the above-mentioned drawbacks and meets the standards laid down The invention pertains to a system for the integration of I.F.F. sum and difference channels in a radar surveillance antenna, said antenna comprising a horn-type primary source which illuminates an offset type of reflector wherein the primary source of the I.F.F. sum channel is obtained by two radiating elements placed in the horn, and wherein the primary source of the I.F.F. sum channel is obtained by four radiating elements placed two by two on either side of the horn.

Furthermore, in this system of integration, the horizontally polarized signals of the difference channel, after appropriate phase-shifting in a phase shifter, are mixed by means of a coupler with the vertically polarized signals of the sum channel, thus making it possible to obtain a reduction in the stray cross-polarized signals of the I.F.F. sum channel.

Furthermore, the horizontally polarized signals of the sum channel, after appropriate phase-shifting in a circuit, are mixed by means of a coupler with the vertically polarized signals of the difference channel, thus making it possible to obtain a reduction in the stray cross-polarized signals of the I.F.F. difference channel.

Each radiating element is formed by a resonant cavity that comprises a metallic, rectangular box, the bottom of which has a radiating, metallic plate lying on a dielectric layer, and the lid of which is formed by a conductive plate that is borne by a dielectric layer and faces the radiating conductive plate.

BRIEF DESCRIPTION OF THE DRAWINGS

Other characteristics and advantages of the present invention will appear from the following description of a particular exemplary embodiment, said description being made with reference to the appended drawings, of which:

FIG. 1 is a schematic front view of the primary source of the radar showing, according to the invention, the position of the radiating elements of the primary source of the I.F.F. channels with respect to the primary source of the radar;

FIGS. 4*a* and 4*b* are drawings indicating the combinations of the signals in the I.F.F. sum channel;

FIGS. 5*a* and 5*b* are drawings indicating the combinations of the signals in the I.F.F. difference channel;

DESCRIPTION OF THE PREFERRED EMBODIMENTS

Figure 2:
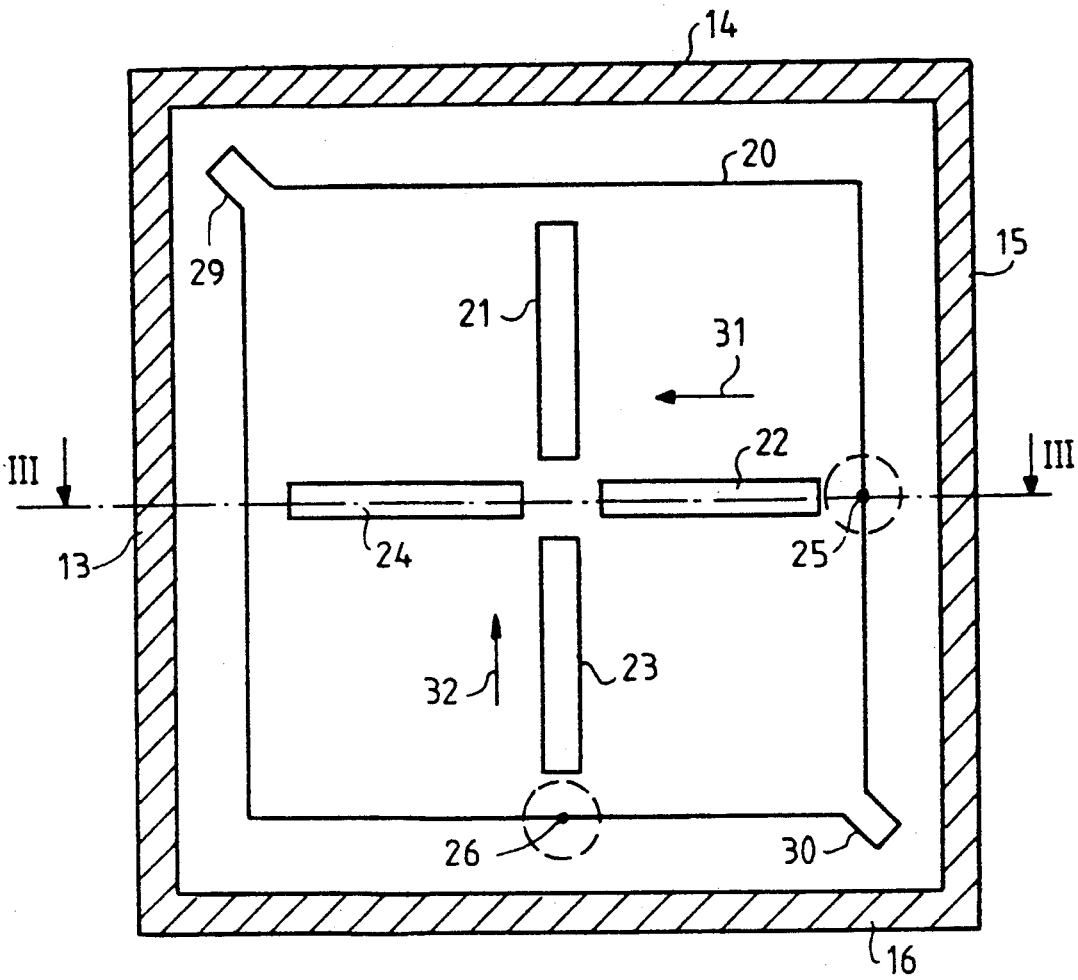
FIG. 2 is a sectional view of a radiating element of the I.F.F. primary source along the line II—II of FIG. 3.

The invention can be applied to a surveillance radar antenna comprising a primary source and a reflector which is illuminated by the signals emitted by the primary source. The reflector has the shape of a paraboloid with a double curve and the primary source is slightly offset with respect to the focus of the paraboloid. Such an antenna is often called an offset primary source or offset reflector antenna.

The primary source is set up by means of a "tulip" type horn (FIG. 1) which is connected to the radar emitter by a waveguide provided with a polarizer so as to obtain a circular polarization of the radar signal emitted. This horn can also propagate the $TE_{10}$ mode in vertical polarization and the $TE_{01}$ mode in horizontal polarization.

According to the invention, the I.F.F. sum channel is obtained by means of two identical radiating elements 3 and 4 placed in the horn 1, while the I.F.F. difference channel is obtained by means of four radiating elements 5, 6, 7 and 8, that are identical to the elements 3 and 4 but are placed two by two on either side of the horn 1. The elements 3 and 4 are placed in the high wall 9 and low wall 10 of the horn, and are inclined with respect to the plane of the aperture of the horn. The elements 5 to 8 are placed in a plane parallel to that of the aperture of the horn 1.

Figure 3:
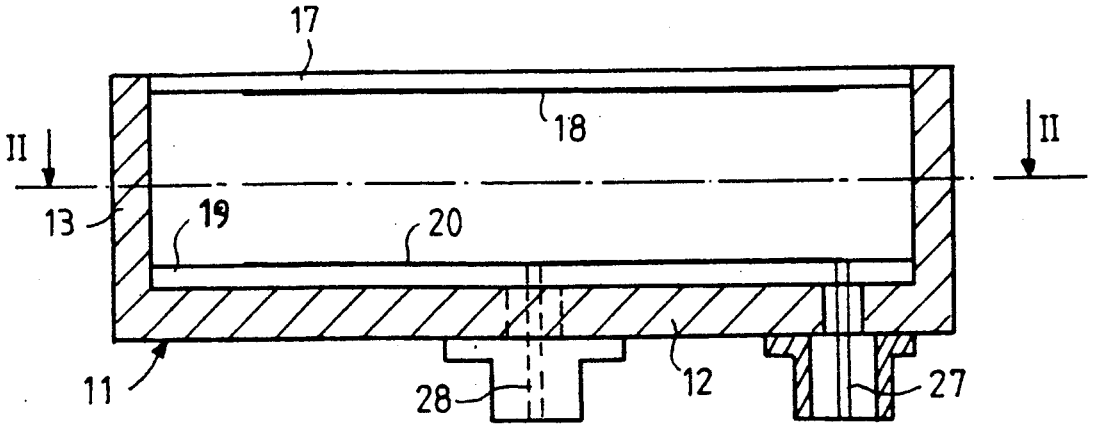
FIG. 3 is a sectional view of the radiating element of the I.F.F. primary source along the line III—III of FIG. 2.

Each radiating element 3 to 8 is formed, as shown in FIGS. 2 and 3, by a rectangular cavity 11 made of a metallic material that has a bottom 12 and four sides 13, 14, 15 and 16. The cavity is closed by a lid 17 which is made of a dielectric material. The internal wall of the lid is lined with a rectangular metallic layer 18. The set comprising the lid 17 and the metallic layer 18 is a so-called directive plate.

The bottom 12 of the box is coated with a dielectric layer 19 surmounted by a rectangular, metallic layer 20 in which four slots 21, 22, 23 and 24 are made. These slots are arranged to form a cross. The microwave signals are applied to the cavity 11 by means of the slotted plate 20 which is connected at two points, 25 and 26, to coaxial lines 27 and 28 respectively. The point 25 is aligned with the horizontal slots 22 and 24, while the point 26 is aligned with the vertical slots 21 and 23. The unit formed by the dielectric layer 19 and the metallic layer 20 constitutes a so-called radiating plate.

Corners of the slotted rectangular plate 20 end in metal tongues 20 and 30 used to achieve perfect matching by adjusting their width and their length. The set forms a cavity that radiates the energy on a single face, namely the face 17. When the microwave signal is applied to the point 25, the electrical field vector 31 is horizontal (horizontal polarization). By contrast, when the microwave signal is applied to the point 26, the electrical field vector 32 is vertical (vertical polarization). In the rest of the description, the point 25 of the radiating elements shall be referenced H in association with a numerical index. Similarly, the point 26 of the radiating elements will be referenced by the letter V associated with a numerical index. The numerical indices 1 and 2 have been assigned respectively to the radiating elements 3 and 4, the numerical indices 3 and 4 have been assigned respectively to the radiating elements 5 and 8, and the numerical indices 5 and 6 have been assigned respectively to the radiating elements 6 and 7.

To obtain the vertically polarized I.F.F. sum channel, the points $V_1$ and $V_2$ of the radiating elements 3 and 4 are excited by means of a hybrid ring junction circulator 33 (FIG. 4-*a*) so as to propagate the $TE_{10}$ mode in vertical polarization in the horn 1. For this purpose, the circulator 33 has four input/output terminals $B_1$, $B_2$, $B_3$ and $B_4$ which are respectively connected to the I.F.F. signal source, the point $V_1$, the point $V_2$ and a load $C_1$. Thus, an I.F.F. signal applied at $B_1$ is divided into two signals in phase which appear at the terminals $B_2$ and $B_3$. This mode of operation is used at reception.

Since the circulator operates reciprocally, phase signals received at $V_1$ and $V_2$ have their sum $S_V$ which appears at the terminal $B_1$. This mode of operation is used at reception.

To obtain the I.F.F. sum channel in horizontal polarization, the points $H_1$ and $H_2$ are respectively connected to the terminals $B_2$ and $B_3$ of a hybrid ring junction 34. The sum signal $S_H$, in horizontal polarization, is then obtained at the terminal $B_1$. the terminal $B_4$ is connected to the load impedance.

To obtain the I.F.F. difference channel, the lateral radiating elements 5, 6, 7 and 8 are obtained, and the following connections, which shall be described in relation to FIGS. 5-*a* and 5-*b*, are obtained. The outputs $V_3$ and $V_4$ of the radiating elements 5 and 8 are combined to be connected to the terminal $B_2$ of a hybrid ring junction circulator 35. Similarly, the outputs $V_5$ and $V_6$ of the radiating elements 6 and 7 are combined to be connected to the terminal $B_4$ of the circulator 35. Then the vertically polarized difference signal $D_H$ is collected at the terminal $B_1$. As for the terminal $B_3$, it is connected to a load.

To obtain the horizontally polarized difference signal $D_H$, the outputs $H_3$ and $H_4$ of the radiating elements 5 and 8 are combined to be connected to the terminal $B_2$ of a hybrid ring junction circulator 36. Similarly, the outputs $H_5$ and $H_6$ of the radiating elements 6 and 7 are combined to be connected to the terminal $B_4$ of the circulator 36. The difference signal $D_H$ is then collected at the terminal $B_1$. Here too, the terminal $B_3$ is connected to a load.

The description that has just been made, in relation to FIGS. 1 to 5, shows that it is possible, in implementing the invention, to make an I.F.F. antenna integrated into a double curvature reflector type radar with an offset primary source.

Figure 6:
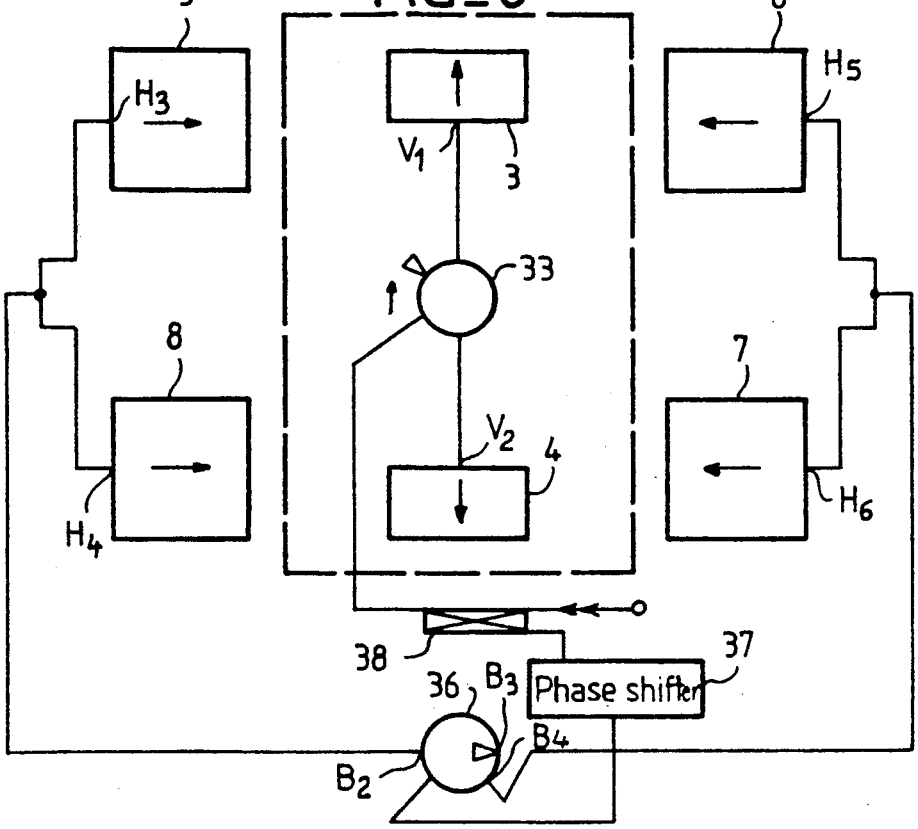
FIG. 6 is a diagram showing an exemplary embodiment of the neutralizing of the I.F.F. sum channel.
Figure 7:
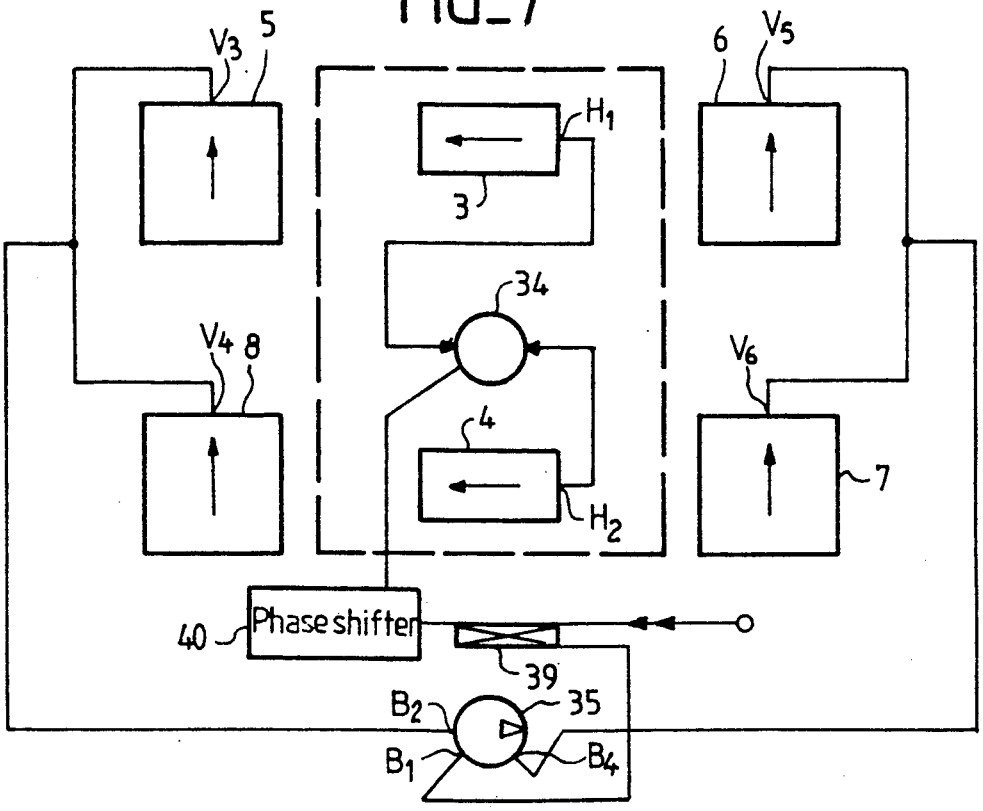
FIG. 7 is a diagram showing an exemplary embodiment of the neutralizing of the I.F.F. difference channel.
Figure 8:
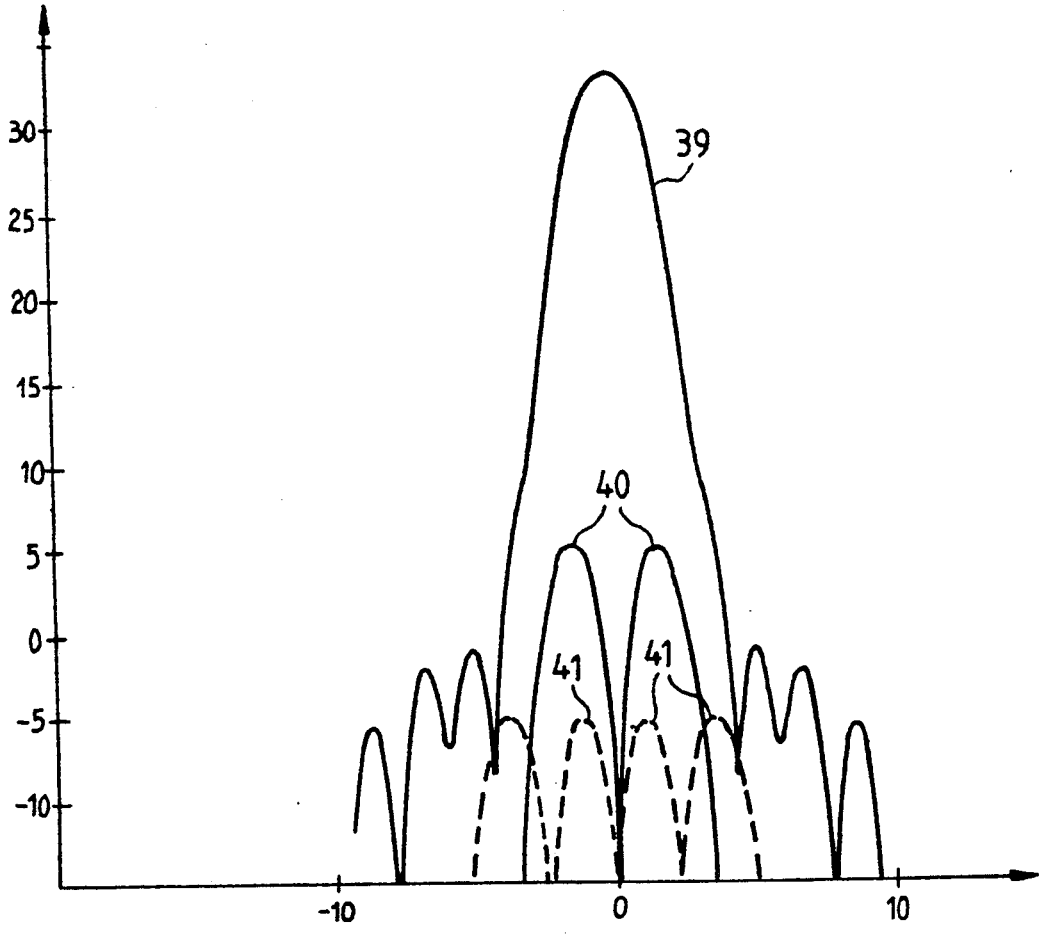
FIG. 8 shows antenna pattern curves that make it possible to show the results obtained by the present invention.

The following description, made with reference to the FIGS. 6, 7 and 8, shows that it is possible, by implementing other aspects of the invention, to reduce the cross-polarization level in the two sum and difference channels by combining the signals received at the above-mentioned I.F.F. antenna.

To this effect, a method for the neutralizing or mixing of the signals received at the different sum and difference channels is implemented. FIG. 6 shows the functional diagram of the neutralizing on the sum channel and FIG. 7 shows the functional diagram of the neutralizing on the difference channel.

It will be recalled that an "offset" reflector which is illuminated by a primary radiation pattern of the even type gives an odd type of radiation pattern in crossed polarization. By contrast, if the reflector is illuminated by an odd type of primary radiation pattern, then the radiation pattern of the reflector will be even in crossed polarization.

In the case of the I.F.F. sum channel in vertical polarization, the radiation pattern in crossed polarization is of an even type. To reduce its level, it is proposed to mix, with the I.F.F. sum channel in vertical polarization, an odd-type primary pattern in horizontal polarization so as to obtain an even type radiation pattern which is subtracted from the radiation pattern in cross-polarization. It is then possible to adjust the level of cross-polarization of the I.F.F. sum channel by adjusting the amplitude and phase of the odd type primary pattern in vertical polarization.

In the particular exemplary embodiment of FIG. 6, the primary pattern used is that of the difference channel in horizontal polarization. For this, the terminals $H_3$ and $H_4$ of the radiating elements 5 and 6 are connected to the terminal $B_2$ of the circulator 36 while the terminals $H_5$ and $H_6$ of the radiating elements 6 and 7 are connected to the terminal $B_4$ of the circulator 36. The difference signal $D_H$ is obtained at the terminal $B_1$ and is applied to a phase shifter 37. The phase-shifted difference signal $D'_H$ is mixed with the signal of the sum channel by means of a coupler 38. By appropriately choosing the value of the phase shift in the phase shifter 37, a substantial reduction is obtained in the level of the cross polarization in the I.F.F. sum channel. In FIG. 8, the curve 39 represents the radiation pattern of the sum channel. When there is no neutralization according to the invention, the cross-polarized radiation pattern is given by the curve 40. With neutralization according to the invention, the cross-polarized radiation diagram is given by the curve 41, which represents an improvement of 10 decibels.

To reduce the level of cross-polarization in the difference channel, the pattern of the sum channel is used in horizontal polarization to mix it, after appropriate phase-shifting, with the pattern of the vertically polarized difference channel. FIG. 7 gives the pattern of a particular exemplary embodiment wherein the terminals $V_3$ and $V_4$ of the radiating elements 5 and 6 are connected to the terminal $B_2$ of the circulator 35 while the terminals $V_5$ and $V_6$ of the radiating elements 6 and 7 are connected to the terminal $B_4$ of the circulator 35. The difference signal $D_V$ is given by the terminal $B_1$ and is applied to a coupler 39. Besides, the terminals $H_1$, $H_2$ of the radiating elements are respectively connected to the terminals $B_2$ and $B_3$ of the circulator 34 and the sum signal $S_H$ is given by the terminal $B_1$. The signal $S_H$ is phase-shifted in a phase shifter $S_H$ which is applied to the coupler 39. By modifying the phase of the signal $S_H$, it is possible to adjust the level of the cross-polarization of the difference channel and obtain a major reduction therein, of the order of ten decibels.

What is claimed is:

1. A system for the integration of I.F.F. sum and difference channels in a radar surveillance antenna including a horn type primary source and an offset type reflector illuminated by said primary source, said system comprising:

two first radiating elements placed in said horn and forming an I.F.F. sum channel primary source;

four second radiating elements placed two by two on either side of said horn and forming an I. F. F. difference channel primary source;

first means to combine output signals of said first elements to form I. F. F. sum channel signals; and second means to combine output signals of said second elements to form I. F. F. difference channel signals, wherein said first and second radiating elements each comprise a first input/output terminal in vertical polarization and a second input/output terminal in horizontal polarization, said first means combine the output signals delivered by said first terminals in vertical polarization of said first radiating elements and said second means combine the output signals delivered by said first terminals in vertical polarization of said second radiating elements, and wherein said system further comprises:

third means to combine the output signals delivered by said second input/output terminals in horizontal polarization of said second radiating elements and give a first neutralizing signal;

a first phase shifter to phase-shift said first neutralizing signal by a first predetermined quantity; and a first coupler to mix the signal given by said first means and the phase-shifted signal given by said first phase shifter so as to deliver said I.F.F. sum channel signals.

2. An integration system according to claim 1, wherein said system further comprises:

fourth means to combine the output signals delivered by said second input/output terminals in horizontal polarization of said first radiating elements and give a second neutralizing signal;

a second phase shifter to phase-shift said second neutralizing signal by a second pre-determined quantity; and a second coupler to mix the signal given by said second means and the phase-shifted signal given by said second phase shifter so as to deliver said I.F.F. difference channel signals.

3. An integration system according to either of the claims 1 or 2, wherein each of said first and second radiating elements comprises:

a metallic, rectangular box having a bottom and a lid; and a radiating conductive plate resting on said bottom by a dielectric layer, said lid being formed by a wall made of dielectric material and a conductive plate borne by said wall and facing said radiating conductive plate.

4. An integration system according to claim 3, wherein the radiating conductive plate has slots arranged in a cross with two orthogonal branch directions the slots in one and the other of said directions being respectively excited from said first and second input/output terminals of said each radiating element.

* * * * *